US010301704B2

(12) United States Patent
Takahashi et al.

(10) Patent No.: US 10,301,704 B2
(45) **Date of Patent: *May 28, 2019**

(54) METHOD FOR SMELTING SAPROLITE ORE

(71) Applicant: SUMITOMO METAL MINING CO., LTD., Tokyo (JP)

(72) Inventors: Junichi Takahashi, Niihama (JP); Taku Inoue, Niihama (JP); Shuuji Okada, Niihama (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/552,031

(22) PCT Filed: Dec. 1, 2015

(86) PCT No.: PCT/JP2015/083784

§ 371 (c)(1),
(2) Date: Aug. 18, 2017

(87) PCT Pub. No.: WO2016/136068

PCT Pub. Date: Sep. 1, 2016

(65) Prior Publication Data

US 2018/0030574 A1 Feb. 1, 2018

(30) Foreign Application Priority Data

Feb. 24, 2015 (JP) ..... 2015-033941

(51) Int. Cl.
*C22B 23/02* (2006.01)
*C21B 13/10* (2006.01)
(Continued)

(52) U.S. Cl.
CPC ..... *C22B 23/023* (2013.01); *C21B 13/10* (2013.01); *C22B 1/16* (2013.01); *C22B 5/10* (2013.01); *C22B 23/02* (2013.01)

(58) Field of Classification Search
None
See application file for complete search history.

(56) References Cited

U.S. PATENT DOCUMENTS 3,652,069 A * 3/1972 Worner ..... C21B 5/008 266/154
3,849,113 A 11/1974 Ban
(Continued)

FOREIGN PATENT DOCUMENTS

CA 958221 A 11/1974
CA 1332286 C 10/1994
(Continued)

OTHER PUBLICATIONS

Geology for Investors, "Nickel Laterites: The World's Largest Source of Nickel", published on or before Jun. 12, 2014.*
(Continued)

*Primary Examiner* — George Wyszomierski
(74) *Attorney, Agent, or Firm* — Locke Lord LLP; James E. Armstrong, IV; Nicholas J. DiCeglie, Jr.

(57) ABSTRACT

Provided is a smelting method whereby a reaction for reducing pellets, said pellet being formed by using a saprolite ore as a starting material, can be effectively conducted and thus an iron/nickel alloy having a nickel grade of, for example, 16% or greater can be obtained. The method comprises: a pellet production step (S1) for producing the pellets from the saprolite ore; and a reduction step (S2) for heating and reducing the obtained pellets in a smelting furnace. In the pellet production step (S1), at least the saprolite ore and a preset amount of a carbonaceous reducing agent are mixed together to produce the pellets. In the reduction step (S2), a hearth carbonaceous reducing agent is preliminarily spread on the hearth of the smelting furnace and the pellets produced above are placed on the hearth
(Continued)

carbonaceous reducing agent and then subjected to a heat reduction treatment.

4 Claims, 5 Drawing Sheets

(51) Int. Cl.
*C22B 1/16* (2006.01)
*C22B 5/10* (2006.01)

(56) References Cited

U.S. PATENT DOCUMENTS

| | | | | |
|---|---|---|---|---|
| 3,854,936 | A | 12/1974 | Hunter et al. | |
| 4,049,444 | A | 9/1977 | Bell et al. | |
| 4,195,986 | A | 4/1980 | Schulz et al. | |
| 4,445,932 | A * | 5/1984 | Onischin | C22C 35/005 75/10.34 |
| 4,490,169 | A | 12/1984 | Persson | |
| 4,701,217 | A * | 10/1987 | Warner | C21B 13/0006 75/499 |
| 5,178,666 | A | 1/1993 | Diaz et al. | |
| 9,752,210 | B2 * | 9/2017 | Takahashi | C22B 23/021 |
| 2005/0211020 | A1 | 9/2005 | Sugitatsu et al. | |
| 2013/0074654 | A1 | 3/2013 | Ito | |
| 2015/0292055 | A1 | 10/2015 | Tsushima et al. | |
| 2017/0342514 | A1 * | 11/2017 | Takahashi | C21B 13/10 |

FOREIGN PATENT DOCUMENTS

| | | | |
|---|---|---|---|
| CN | 101020957 | A | 8/2007 |
| CN | 101392330 | A | 3/2009 |
| CN | 101481753 | A | 7/2009 |
| CN | 102643976 | A | 8/2012 |
| EP | 1167547 | A1 | 1/2002 |
| EP | 2226403 | A1 | 9/2010 |
| GB | 929201 | A * | 6/1963 |
| JP | 50-105506 | A | 8/1975 |
| JP | 01-021855 | | 4/1989 |
| JP | 05-311265 | A | 11/1993 |
| JP | 06-025770 | A | 2/1994 |
| JP | 2001-181720 | A | 7/2001 |
| JP | 2002-285213 | A | 10/2002 |
| JP | 2003-239008 | A | 8/2003 |
| JP | 2004-156140 | A | 6/2004 |
| JP | 2010-229525 | A | 10/2010 |
| JP | 2011-256414 | A | 12/2011 |
| WO | 2010/032513 | A1 | 3/2010 |
| WO | 2014/065240 | A1 | 5/2014 |
| WO | 2014/080831 | A1 | 5/2014 |

OTHER PUBLICATIONS

International Search Report dated Mar. 1, 2016, issued for PCT/JP2015/083784.
Office Action dated Dec. 27, 2017, issued to CN Patent Application No. 201580069669.9.
Office Action dated Feb. 8, 2018, issued to CN Patent Application No. 201580075742.3.
International Search Report issued to International Application No. PCT/JP2015/076198 dated Dec. 15, 2015.
Notice of Reasons for Rejection issued to JP Patent Application No. 2014-260759, dated Mar. 29, 2016.
Extended European search report issued to EP Patent Application No. 15872381.7, dated Sep. 25, 2017.
Examination report issued to AU Patent Application No. 2015384741, dated Sep. 25, 2017.
Extended European search report issued to EP Patent Application No. 15883358.2, dated Oct. 10, 2017.
Examination report issued to AU Patent Application No. 2015369215, dated Oct. 17, 2017.
Office Action issued to U.S. Appl. No. 15/537,965, dated Nov. 3, 2017.
Office Action issued in corresponding European Patent Application No. EP 15872381.7, dated Jun. 11, 2018.

* cited by examiner

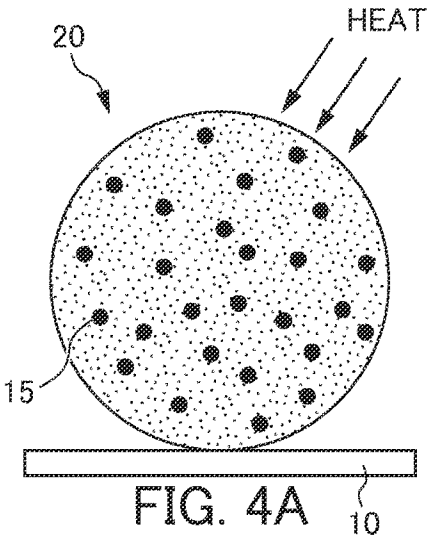
FIG. 4A
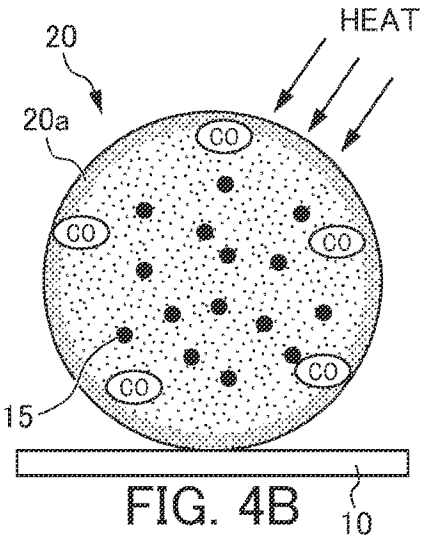
FIG. 4B
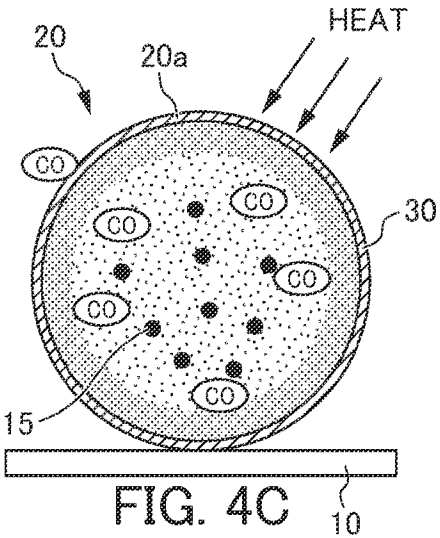
FIG. 4C
FIG. 4D
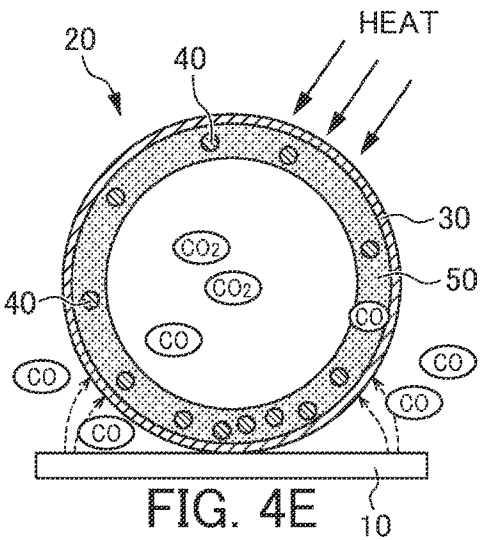
FIG. 4E
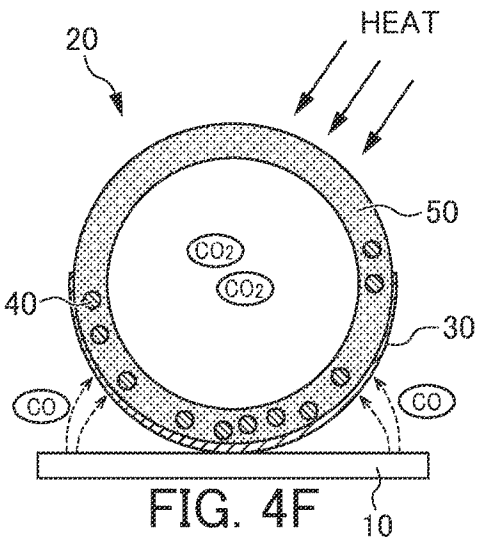
FIG. 4F

METHOD FOR SMELTING SAPROLITE ORE

TECHNICAL FIELD

The present invention relates to a method for smelting saprolite ore as one type of nickel oxide ore. More specifically, the present invention relates to a method for smelting saprolite oxide ore, including: forming a pellet from saprolite ore serving as raw material ore; and heat-reducing the pellet in a smelting furnace, thereby smelting the saprolite ore.

BACKGROUND ART

As methods for smelting nickel oxide ore which may also be called limonite or saprolite, known are a dry smelting method for producing nickel matt using a flash smelting furnace, a dry smelting method for producing an iron-nickel alloy (ferronickel) using a rotary kiln or moving hearth furnace, a wet smelting method for producing mixed sulfide using an autoclave and the like.

Dry smelting of saprolite ore commonly includes roasting the ore in a rotary kiln, and then melting the roasted ore in an electric furnace to obtain a ferronickel metal, and then separating a slag. At this time, some iron is allowed to remain in the slag for maintaining the concentration of nickel in the ferronickel metal at a high level. However, it disadvantageously requires a large amount of electric energy because the whole amount of saprolite ore needs to be melted to generate a slag and a ferronickel.

Patent Document 1 discloses a method including inputting oxidized nickel ore and a reducing agent (anthracite) into a rotary kiln, and reducing the ore in a semi-molten state to reduce parts of nickel and iron into metal, and then recovering a ferronickel by gravity separation or magnetic separation. Advantageously, according to the above method, a ferronickel metal can be obtained without performing electric melting, leading to reduced energy consumption. However, the method suffers from the following problems: reduction is performed in a semi-molten state, and thus the produced metal will be dispersed in the form of small particles; and the yield of nickel metal will be relatively low partly due to losses during gravity separation and magnetic separation.

Further, Patent Document 2 discloses a method for producing a ferronickel using a moving hearth furnace. The method described in the above document includes mixing raw materials containing nickel oxide and iron oxide with a carbonaceous reducing agent to form a pellet, and heat-reducing the mixture in a moving hearth furnace to obtain a reduced mixture, and then melting the reduced mixture in a separate furnace to obtain a ferronickel. The document describes that alternatively, both slag and metal or one of either may be melted in a moving hearth furnace. However, melting the reduced mixture in a separate furnace requires a large amount of energy as in the melting process in an electric furnace. Further, disadvantageously, the slag and the metal may be fused to the furnace floor when melted in the furnace, resulting in difficult discharge from the furnace.

Here, with regard to the nickel grades in iron-nickel alloys, the Japanese Industrial Standard (JIS) specifies the nickel grade in a ferronickel as shown in Table 1. According to this, the nickel grade in a ferronickel needs to be 16% or more for a commercial ferronickel.

TABLE 1

| Type | | Abbreviation | Chemical components (%) | | | | | | | | |
|---|---|---|---|---|---|---|---|---|---|---|---|
| | | | Ni | C | Si | Mn | P | S | Cr | Cu | Co |
| High carbon ferronickel | No. 1 | FNi H1 | 16.0 or more | 3.0 or more | 3.0 or less | 0.3 or less | 0.05 or less | 0.03 or less | 2.0 or less | 0.10 or less | Ni × 0.05 or less |
| | No. 2 | FNi H2 | 16.0 or more | less than 3.0 | 5.0 or less | 0.3 or less | 0.05 or less | 0.03 or less | 2.5 or less | 0.10 or less | Ni × 0.05 or less |
| Low carbon ferronickel | No. 1 | FNi L1 | 28.0 or more | 0.02 or less | 0.3 or less | — | 0.02 or less | 0.03 or less | 0.3 or less | 0.10 or less | Ni × 0.05 or less |
| | No. 2 | FNi L2 | 17.0 or more and less than 28.0 | 0.02 or less | 0.3 or less | — | 0.02 or less | 0.03 or less | 0.3 or less | 0.08 or less | Ni × 0.05 or less |

Patent Document 1: Japanese Examined Patent Application Publication No. H01-021855

Patent Document 2: Japanese Unexamined Patent Application, Publication No. 2004-156140

DISCLOSURE OF THE INVENTION

Problems to be Solved by the Invention

The present invention is proposed in view of the above actual circumstances. An object of the present invention is to provide a method for smelting saprolite ore, including producing a pellet from the saprolite ore, and heat-reducing the pellet in a smelting furnace to obtain an iron-nickel alloy (ferronickel), in which an iron-nickel alloy having, for example, a nickel grade of 16% or more in a ferronickel satisfying the specification described in the Japanese Industrial Standard for ferronickels can be obtained by promoting a smelting reaction in the smelting step (reduction step).

Means for Solving the Problems

The present inventors have conducted extensive studies to achieve the above object. After those extensive studies, the present inventors found that a reduction reaction can be effectively promoted to obtain an iron-nickel alloy with a high nickel grade by mixing saprolite ore serving as a raw material with a carbonaceous reducing agent in a specific ratio to produce a pellet, and charging the pellet into a smelting furnace with the furnace floor covered with the carbonaceous reducing agent (furnace-floor carbonaceous reducing agent), and performing reduction heat treatment.

Then, the present invention was completed. That is, the present invention can provide the following.

(1) A first embodiment of the present invention is a method for smelting saprolite ore, in which a pellet is formed from the saprolite ore, and the pellet is heat-reduced to obtain an iron-nickel alloy with a nickel grade of 16% or more, the method including: a pellet production step for producing a pellet from the saprolite ore, and a reduction step of heat-reducing the resulting pellet in a smelting furnace, the pellet production step including mixing the saprolite ore with at least a carbonaceous reducing agent, the mixed amount of the carbonaceous reducing agent being adjusted so that the amount of carbon is 25% or less when the total value of a chemical equivalent required for reducing nickel oxide contained in the resulting pellet into nickel metal and a chemical equivalent required for reducing iron oxide contained in said pellet into iron metal is taken as 100%, and agglomerating the resulting mixture to form a pellet, and the reduction step including pre-covering the furnace floor of the smelting furnace with a furnace floor carbonaceous reducing agent before charging the resulting pellet into the smelting furnace, and performing reduction heat treatment with the pellet loaded onto the furnace floor carbonaceous reducing agent.

(2) A second embodiment of the present invention is the method for smelting saprolite ore according to the first embodiment, in which the reduction step includes heat-reducing the pellet loaded onto the furnace floor carbonaceous reducing agent at a heating temperature of 1350° C. or more and 1550° C. or less.

(3) A third embodiment of the present invention is the method for smelting saprolite ore according to the first or second embodiment, in which the temperature when the pellet is charged into the smelting furnace is 600° C. or less.

(4) A fourth embodiment of the present invention is the method for smelting saprolite ore according to any one of the first to third embodiments, in which the pellet production step includes adding an additive other than the carbonaceous reducing agent such that the loading amount of the additive except for the carbonaceous reducing agent is 10% or less relative to the saprolite ore by weight.

(5) A fifth embodiment of the present invention is the method for smelting saprolite ore according to any one of the first to fourth embodiments, in which the time from the start of the heat reduction treatment until the pellet is taken out from the smelting furnace in the reduction step is less than 40 minutes.

(6) A sixth embodiment of the present invention is the method for smelting saprolite ore according to any one of the first to fifth embodiments, further including pulverizing a reduced product obtained from the reduction step, and separating a metal including the iron-nickel alloy from a slag, and then melting the metal to obtain a ferronickel.

Effects of the Invention

According to the present invention, an iron-nickel alloy with a high nickel grade of 16% or more can be obtained by effectively promoting a reduction reaction.

BRIEF DESCRIPTION OF THE DRAWINGS

FIGS. 4A-4E schematically shows a course of the reduction heat treatment for the pellet: (FIG. 4A) the reduction heat treatment, heat is conducted through the surface (surface layer portion) of the pellet 20 to promote a reduction reaction of iron oxide contained in a raw material ore; (FIG. 4B) replacement of nickel oxide (NiO) with FeO is promoted to initiate reduction of Ni at the surface layer portion 20 *a*; (FIG. 4C) a metal-forming process progresses at that surface layer portion 20 *a* to form an iron-nickel alloy and a shell of metal (metal shell) 30; (FIG. 4D) iron is progressively converted into metal (FeO→Fe) at the same time as iron becomes FeO, and melting of the slag 50 progresses—metal particles 40 are produced when some of nickel and iron are converted into iron in the inside of the pellet; (FIG. 4E) As the rate of forming iron metal increases, the amount of FeO decreases, and the melting temperature of the slag 50 increases, resulting in re-solidification of the slag 50; and (FIG. 4F) the metal shell 30 is melted due to the carburization from the furnace-floor carbonaceous reducing agent 10 arranged to cover the furnace floor 1 *a* and the metal shell 30 remains at the surface layer portion 20 *a* in the lower part of the pellet 20 due to surface tension.

PREFERRED MODE FOR CARRYING OUT THE INVENTION

Below, specific embodiments of the present invention (hereafter referred to as the "present embodiments") will be described in detail with reference to the drawings. It is noted that the present invention shall not be limited to the following embodiments, and various modifications may be made without departing from the scope and the gist of the present invention.

<<Method for Smelting Saprolite Ore>>

First, the method for smelting saprolite ore serving as a raw material ore will be described. Below, used as an example is a method for smelting, including pelletizing saprolite ore used as raw material ore, and reducing the resulting pellet to generate a metal (an iron-nickel alloy (hereinafter, the iron-nickel alloy may be referred to as a "ferronickel")) and a slag, and then separating the metal from the slag to produce the ferronickel.

Figure 1:
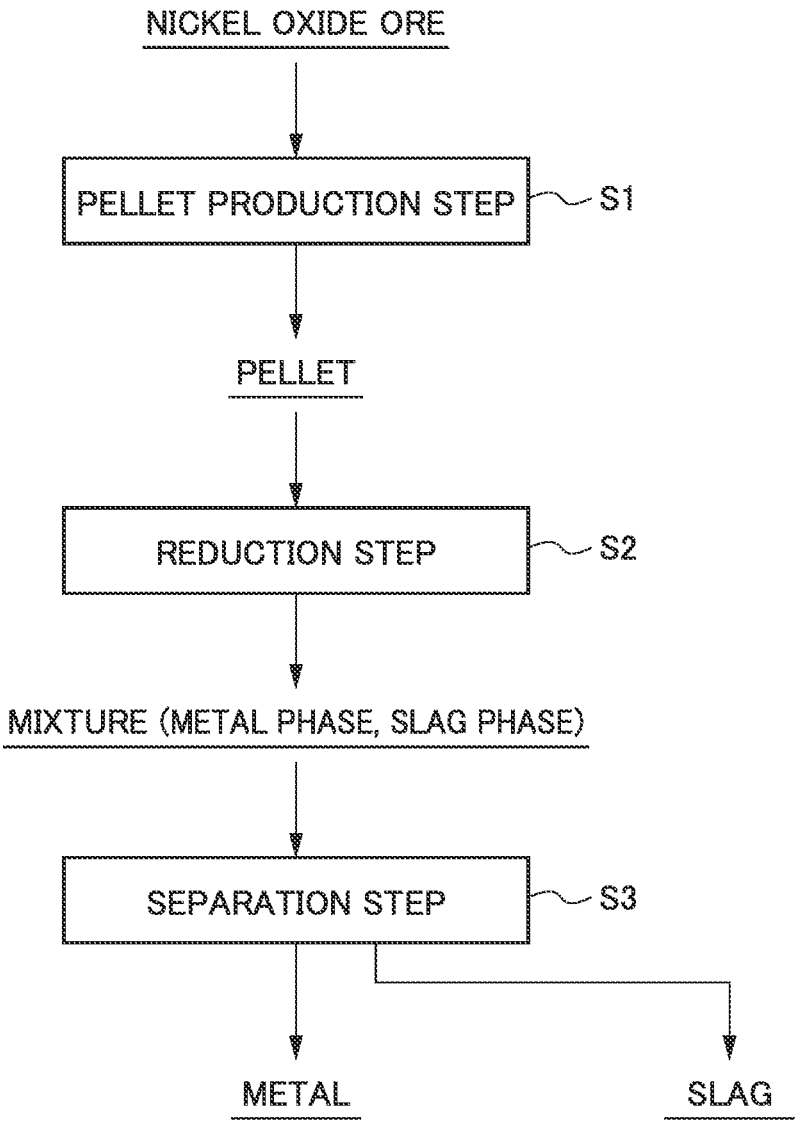
FIG. 1 is a process drawing showing the flow of a method for smelting saprolite ore.

The method for smelting saprolite ore according to the present embodiment includes preparing a pellet of saprolite ore, and charging the pellet into a smelting furnace (reducing furnace), and performing heat reduction to obtain an iron-nickel alloy with a nickel grade of 16% or more. Specifically, as shown in the process chart of FIG. 1, the method for smelting saprolite ore according to the present embodiment includes a pellet production step S1 of producing a pellet from the saprolite ore, a reduction step S2 of heat-reducing the resulting pellet at a predetermined reduction temperature in a reducing furnace, and a separation step S3 of separating a metal from a slag generated in the reduction step S2 to recover the metal.

<1. Pellet Production Step>

In the pellet production step S1, a pellet is produced from saprolite ore serving as raw material ore. The saprolite ore serving as raw material ore is nickel oxide ore having an Ni grade of 1.5% to 2.5% and an Fe grade of 13% to 25% with a composition of MgO/SiO=0.3 to 1.0. Here, an example of the composition (weight %) of saprolite ore is shown in the following Table 2. However, the composition of saprolite ore shall not be limited to this.

TABLE 2

| Composition of saprolite ore (in terms of metal, wt %) | | | | | | | | |
|---|---|---|---|---|---|---|---|---|
| Fe | Ni | Si | Ca | Al | Mg | Co | Cr | Mn |
| 18.0 | 1.8 | 18.0 | 0.10 | 0.60 | 11.0 | 0.04 | 1.0 | 0.29 |

Figure 2:
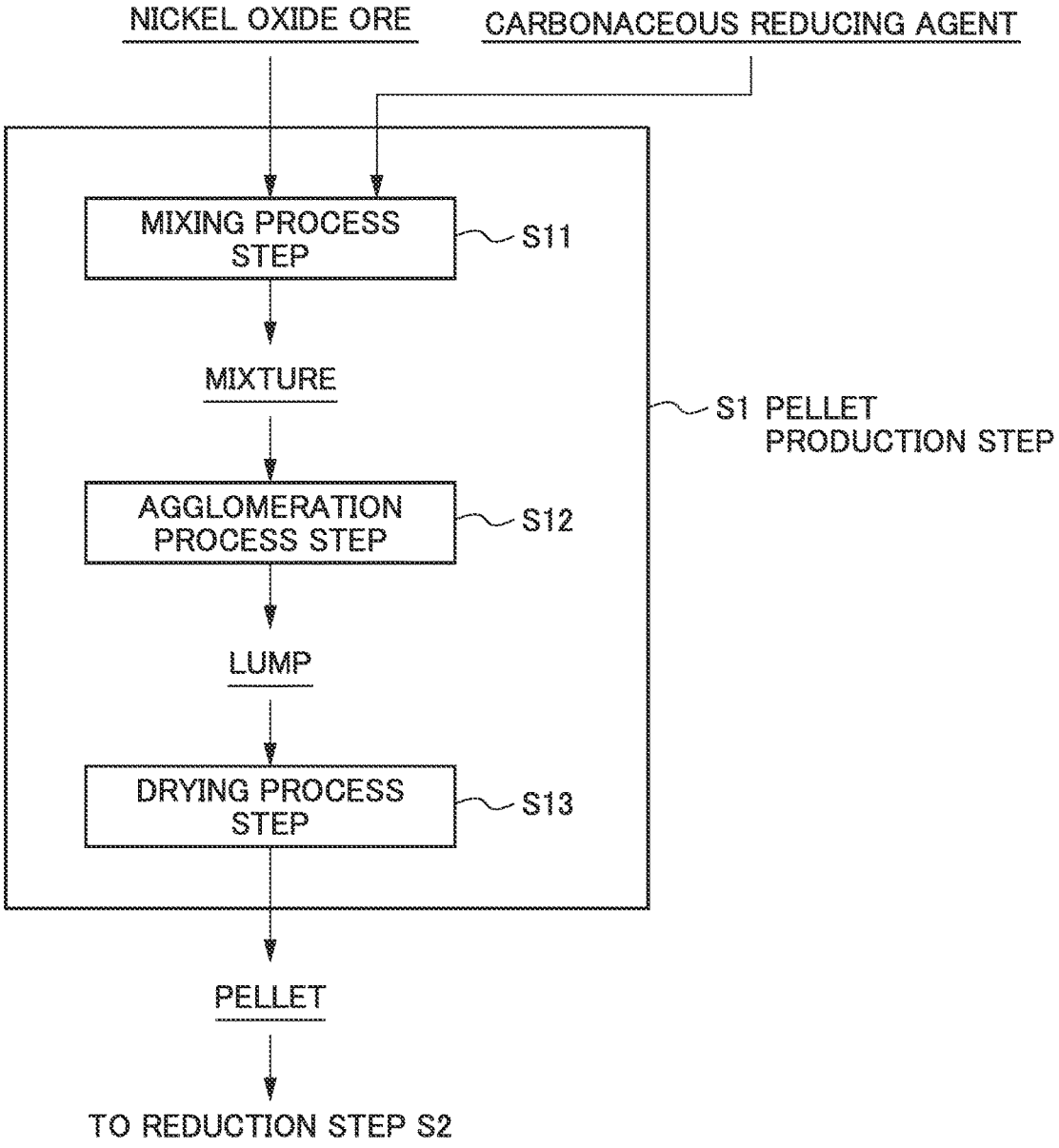
FIG. 2 is a process flowchart showing the flow of processes in the pellet production step of the method for smelting saprolite ore.

FIG. 2 is a process flowchart showing the flow of processing in the pellet production step S1. As shown in FIG. 2, the pellet production step S1 includes a mixing process step S11 of mixing a raw material including the saprolite ore, an agglomeration process step S12 of forming (granulating) the resulting mixture into a lump, and a drying process step S13 of drying the resulting lump.

(1) Mixing Process Step

In the mixing process step S11, a raw material powder containing saprolite ore is mixed to obtain a mixture. Specifically, in the mixing process step S11, the carbonaceous reducing agent was added and mixed along with saprolite ore serving as raw material ore, and powders of a flux component, a binder, and the like as optional components are mixed to obtain a mixture, the powders having a particle size, for example, on the order of 0.2 mm to 0.8 mm.

Here, when producing a pellet according to the present embodiment, a specific amount of a carbonaceous reducing agent is mixed to obtain a mixture, which is then used to form the pellet. There is no particular limitation for the carbonaceous reducing agent, but examples include coal powder, coke powder and the like. It is noted that the carbonaceous reducing agent preferably has a particle size similar to that of the aforementioned saprolite ore as raw material ore.

Here, the mixed amount of the carbonaceous reducing agent is adjusted so that the amount of carbon is 25% or less when the total value of a chemical equivalent required for reducing the total amount of nickel oxide contained in the resulting pellet into nickel metal and a chemical equivalent required for reducing iron oxide contained in said pellet into iron metal (which may be referred to as the "total value of the chemical equivalents") is taken as 100%.

As described above, in the mixing process step S11, a specific mixed amount of the carbonaceous reducing agent is mixed with the saprolite ore, i.e., the mixed amount of the carbonaceous reducing agent is adjusted so that the amount of carbon is 25% or less relative to the aforementioned total value of the chemical equivalents being 100%. Then, a pellet is produced from the resulting mixture. This can effectively reduce trivalent iron oxide into divalent iron oxide, and can also convert nickel oxide into metal, and further can reduce the divalent iron oxide into metal to form a metal shell in the reduction heat treatment in the next reduction step S2 as described in detail below. In addition, partial reduction treatment can be performed in which some of the iron oxide contained in the shell is allowed to remain as oxide. These more effectively enable separate formation of a ferronickel metal (metal) with a high nickel grade and a ferronickel slag (slag) in one pellet.

It is noted that there is no particular limitation for the lower limit of the mixed amount of a carbonaceous reducing agent, but it is preferably adjusted so that the amount of carbon is in a proportion of 0.1% or more relative to the total value of the chemical equivalents being 100% in view of a reaction rate.

Further, in the mixing process step S11, a binder, a flux component, and the like can be added as optional additive components in addition to the carbonaceous reducing agent. Specific examples of the binder can include bentonite, polysaccharide, resin, water glass, dewatered cake, and the like. Further, examples of the flux component can include calcium oxide, calcium hydroxide, calcium carbonate, silicon dioxide and the like.

Here, the addition amount of an additive such as a binder and a flux component as described above is preferably 10% or less relative to the mixed amount of the saprolite ore included in the raw material composition. As described in detail below, when the addition amount of such an additive is 10% or less relative to the saprolite ore, a slag formed by reductively treating a pellet can remain more effectively at a half-molten state. This can prevent an iron-metal forming reaction, further improving the nickel grade.

(2) Agglomeration Process Step

In the agglomeration process step S12, the mixture of raw material powders obtained in the mixing process step S11 is formed (granulated) into a lump. Specifically, an amount of water required for agglomeration is added to the mixture obtained in the mixing process step S11, and a pellet-like lump is formed with a lump production device (such as a rolling granulator, a compression molding machine, and an extrusion machine) or by hand.

There is no particular limitation for the shape of the pellet, but it may be, for example, spherical. Further, there is no particular limitation for the size of the lump to be formed into a pellet-like shape, but it may be, for example, on the order of 10 mm to 30 mm in terms of the size of a pellet (or the diameter in the case of a spherical pellet) to be charged into a smelting furnace in the reduction step after subjected to the drying process and the preheat treatment described below.

(3) Drying Process Step

In the drying process step S13, the lump obtained from the agglomeration process step S12 is subjected to a drying process. The lump formed into a pellet-like lump in the agglomeration process has an excess content of water as high as, for example, about 50 wt %, resulting in a sticky condition. In the drying process step S13, a drying process is performed so that the solid content of the lump is, for example, about 70 wt %, and the water content is about 30 wt % in order to facilitate the handling of the pellet-like lump.

There is no particular limitation for the drying process of a lump in the drying process step S13, but more specifically, hot air, at 300° C. to 400° C. for example, may be blown against the lump for drying. It is noted that the temperature of a lump when performing the drying process is less than 100° C.

In the pellet production step S1, a raw material powder containing saprolite ore as raw material ore is mixed as described above, and the resulting mixture is granulated (agglomerated) into a pellet-like shape, and dried to produce a pellet. At this time, a specific amount of a carbonaceous reducing agent is mixed depending on the composition of the saprolite ore as described above when mixing raw material powders, and the resulting mixture is used to produce a pellet. The size of the resulting pellet is on the order of 10 mm to 30 mm. Pellets are to be produced which are strong enough to maintain the shapes thereof, such that, for example, the proportion of collapsed pellets is about 1% or less even after they are dropped from a height of 1 m. Such pellets can withstand impacts of dropping and the like upon charging in the subsequent step of the reduction step S2, and can maintain their pellet-like shapes. Further, appropriate spaces will be formed between pellets. These can allow a smelting reaction in the smelting step to progress appropriately.

It is noted that a preheat treatment step may be included in this pellet production step S1, the preheat treatment step including preheating lumped pellets subjected to the drying process in the drying process step S13 described above to a predetermined temperature. Production of pellets via preheating a lump after the drying process as described above can reduce cracks (breaking, crumbling) in pellets induced by heat shock more effectively even when pellets are heat-reduced at a temperature as high as, for example, about 1400° C. in the reduction step S2. For example, the proportion of crumbled pellets relative to the total pellets charged into a smelting furnace can be reduced to a low level, and the pellet-like shape can be maintained more effectively.

Specifically, in the preheat treatment, pellets after the drying process are preheated at a temperature of 350° C. to 600° C. Further, the preheat treatment is preferably performed at a temperature of 400° C. to 550° C. Preheat treatment performed at a temperature of 350° C. to 600° C., preferably at a temperature of 400° C. to 550° C. as described above, can reduce crystal water contained in the saprolite ore in the pellets. Therefore, collapsing of pellets due to the release of their crystal water can be prevented even when the temperature is rapidly increased by being charged into a smelting furnace at about 1400° C. Further, the preheat treatment performed as described above allows the thermal expansion of particles of saprolite ore, a carbonaceous reducing agent, a binder, a flux component, and the like that compose the pellets to proceed slowly in two steps. This, in turn, can prevent collapse of the pellets due to differential expansion of particles. It is noted that there is no particular limitation for the processing time for the preheat treatment, and it can be appropriately adjusted depending on the size of a lump containing saprolite ore. It may be, however, on the order of 10 minutes to 60 minutes when a commonly sized lump is used, from which a pellet with a size on the order of 10 mm to 30 mm can be obtained.

<2. Reduction Step>

In the reduction step S2, the pellet obtained from the pellet production step S1 is heat-reduced at a predetermined reduction temperature. This reduction heat treatment of the pellet in the reduction step S2 promotes a smelting reaction (reduction reaction) to generate metal and slag.

Specifically, the reducing heat treatment in the reduction step S2 is performed in a smelting furnace (reducing furnace) and the like. A pellet containing saprolite ore is charged into the smelting furnace heated to a predetermined temperature for performing heat reduction. Specifically, the reduction heat treatment of a pellet is preferably performed at 1350° C. or more and 1550° C. or less. A heat reduction temperature of less than 1350° C. may not be able to effectively promote a reduction reaction. On the other hand, a heat reduction temperature of more than 1550° C. may excessively promote a reduction reaction, resulting in a decreased nickel grade.

There is no particular limitation for the temperature when a pellet is charged into a smelting furnace, but it is preferably 600° C. or less. Further, it is more preferably 550° C. or less in view that the possibility of burning a pellet due to a carbonaceous reducing agent can be more efficiently reduced.

When the temperature when a pellet is charged into a smelting furnace is more than 600° C., combustion of a carbonaceous reducing agent contained in a pellet may occur. On the other hand, there is no particular limitation for the lower limit, but it is preferably 500° C. or more because a much lower temperature may be disadvantageous in view of heating costs for a process where reduction heat treatment is continuously performed. It is noted that even if the temperature of a pellet upon charging is not controlled within the above temperature range, a pellet can be charged into a smelting furnace without causing any particular problems if charging is completed in a short time during which no impacts from burning and sintering occur.

Figure 3:
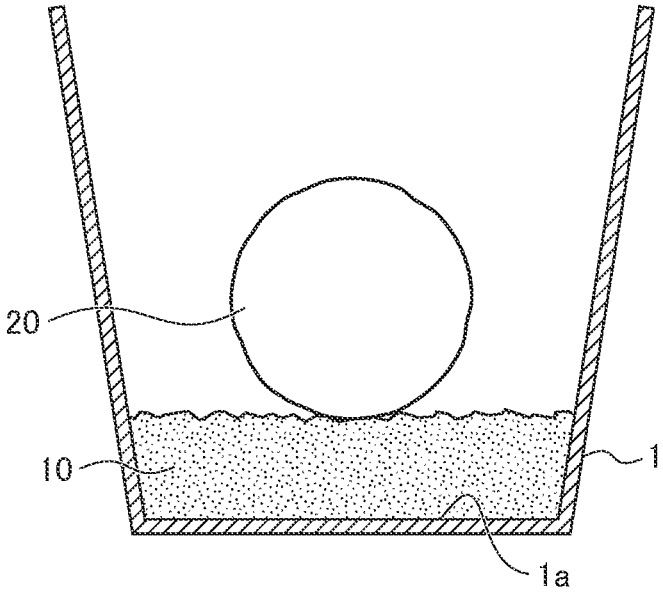
FIG. 3 schematically shows a state where a pellet is charged into a smelting furnace.

Now, in the present embodiment, for charging the resulting pellet in a smelting furnace, the furnace floor of said smelting furnace is pre-covered with a carbonaceous reducing agent (hereinafter referred to as the "furnace floor carbonaceous reducing agent"), and pellets are loaded onto said furnace floor carbonaceous reducing agent pre-covering the floor to perform reduction heat treatment. Specifically, as shown in the schematic view of FIG. 3, the furnace floor 1*a* of a smelting furnace 1 is pre-covered with a furnace floor carbonaceous reducing agent 10, for example, coal powder and the like, onto which a produced pellet 20 is loaded to perform the reduction heat treatment.

Here, FIGS. 4A to 4F schematically show the course of the reduction reaction in a pellet when the reduction heat treatment is performed in the reduction step S2. First, in the present embodiment as described above, the furnace floor of the smelting furnace is pre-covered with a furnace floor carbonaceous reducing agent 10, and a pellet 20 is loaded onto that furnace floor carbonaceous reducing agent 10, and then the reduction heat treatment is started.

In the reduction heat treatment, heat is conducted through the surface (surface layer portion) of the pellet 20 to promote a reduction reaction of iron oxide contained in a raw material ore as shown in the following reaction formula (i) (FIG. 4A), for example.

$$Fe_2O_3+C \rightarrow Fe_3O_4+CO \quad \text{(i)}$$

When reduction at the surface layer portion 20*a* of the pellet 20 progresses to a reduction level of FeO ($Fe_3O_4$+C→FeO+CO), replacement of nickel oxide (NiO) combined as NiO—$SiO_2$ with FeO is promoted to initiate reduction of Ni at the surface layer portion 20*a* as represented by the following reaction formula (ii) (FIG. 4B), for example. Subsequently, a reaction similar to the above reduction reaction of Ni is gradually promoted in the inside as heat is conducted from the outside.

$$NiO+CO \rightarrow Ni+CO_2 \quad \text{(ii)}$$

When the reduction reaction of iron oxide as shown, for example, in the following reaction formula (iii) progresses along with the reduction reaction of nickel oxide at the surface layer portion 20*a* of the pellet 20, a metal-forming process progresses at that surface layer portion 20*a* in a very short time such as about 1 minute to form an iron-nickel alloy and a shell of metal (metal shell) 30 is then formed (FIG. 4C). It is noted that the shell 30 formed at this stage is extremely thin, allowing CO/$CO_2$ gas to easily pass through it. Therefore, the reaction gradually proceeds toward the inside as heat is conducted from the outside.

$$FeO+CO \rightarrow Fe+CO_2 \quad \text{(iii)}$$

Figure 5:
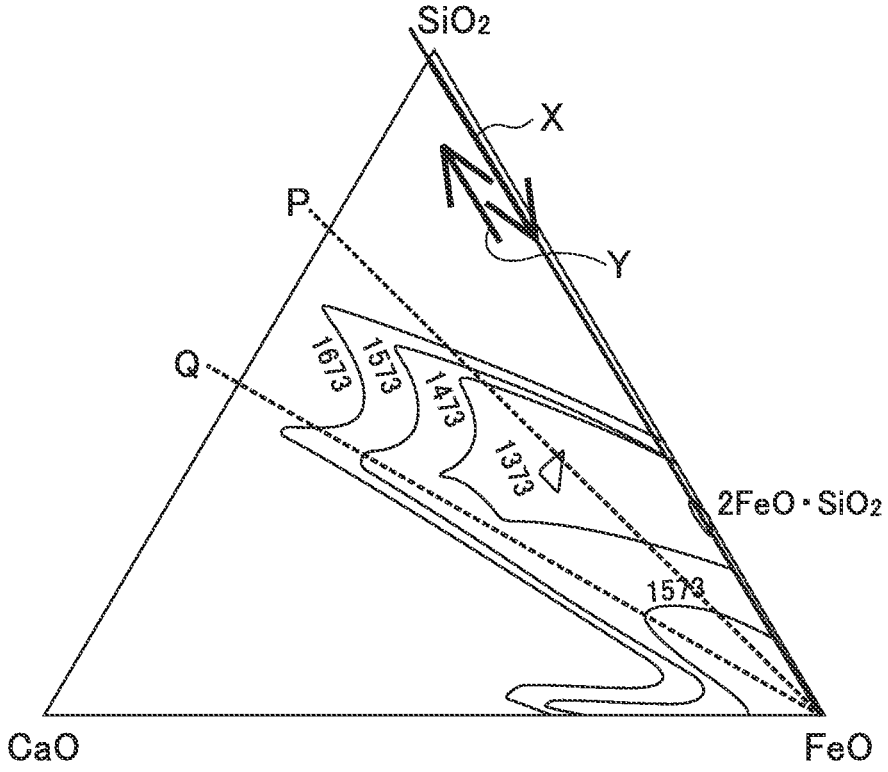
FIG. 5 shows the phase diagram of the ternary system of FeO—$SiO_2$—CaO.

Here, the phase diagram of the FeO—$SiO_2$—CaO ternary system is shown in FIG. 5, and a line representing the change in the composition of a slag is shown over the phase diagram. It is noted that the solid line shown in FIG. 5 represents a melting temperature of a slag, showing regions where a slag has a low melting point are present in a region where the proportion of FeO is large (the center to the lower right side of the triangle). Almost no Ca is contained in the saprolite ore of raw material ore, and thus, in the present embodiment, the composition of a slag charges along a line representing a composition having almost no Ca and the like in the phase diagram shown in FIG. 5.

When reduction of iron oxide progresses by heating reduction treatment in the reduction step S2 as described above (for example, $Fe_2O_3 \rightarrow FeO$), the composition changes in the direction of an arrow X shown in the phase diagram of FIG. 5 as FeO increases, gradually approaching a region where a slag has a low melting point to initiate melting. In the half-molten state where a slag is partially melted, some iron is converted into metal (FeO→Fe). However, as the formation of iron metal progresses, and as the amount of FeO decreases, the melting temperature of the slag increases, resulting in solidification of the slag (an arrow Y shown in the phase diagram of FIG. 5). In the present embodiment, the mixed amount of a carbonaceous reducing agent in a pellet is adjusted so that the amount of carbon is 25% or less relative to the aforementioned total value of the chemical equivalents being 100%. This can prevent an iron-metal forming reaction based on the aforementioned mechanism.

FIGS. 4D to 4E schematically show how these reactions take place in the inside of the pellet in a more specific way. That is, the reduction reaction progresses from the surface layer portion 20*a* of the pellet 20 by heating to produce the metal shell 30. In the present embodiment, the amount of the carbonaceous reducing agent 15 in the pellet is adjusted so that the amount of carbon is 25% or less relative to the aforementioned total value of the chemical equivalents being 100%. This reduces the total amount of metals (nickel and iron) produced in the reduction reaction, making the metal shell 30 very thin. It is noted that some iron is progressively converted into metal (FeO→Fe) at the same time as iron becomes FeO, and melting of the slag 50 progresses (FIG. 4D). In a state shown in FIG. 4D, metal particles 40 are produced when some of nickel and iron are converted into iron in the inside of the pellet.

As the rate of forming iron metal increases, the amount of FeO decreases, and the melting temperature of the slag 50 increases, resulting in re-solidification of the slag 50 (FIG. 4E) as described above. The slag 50 solidified as described above is in a state where the metal particles 40 are dispersed therein. Meanwhile, the metal shell 30 will be melted due to the carburization from the furnace-floor carbonaceous reducing agent 10 arranged to cover the furnace floor 1*a*. However, the amount of the metal shell 30 is small, and thus the metal shell 30 remains at the surface layer portion 20*a* in the lower part of the pellet 20 due to surface tension (FIG. 4F). Reduction continues to progress due to a CO gas generated from the carbonaceous reducing agent 10 arranged to cover the furnace floor 1*a*, but the rate of the reduction is slow, because the slag 50 is fixed, resulting in reduced formation of iron metal.

As described above, in the heating reduction treatment of the pellet 20 prepared by using saprolite ore as raw material ore according to the present embodiment, the amount of the carbonaceous reducing agent 15 to be included in the pellet 20 is adjusted so that the amount of carbon is 25% or less relative to the total value of the chemical equivalents being 100%. This can effectively reduce formation of iron metal.

Here, the amount of Ca is low in the saprolite ore as raw material ore. Therefore, an excessive addition of, for example, limestone, may produce the composition of a slag represented by the dotted line of the "P line" shown in the phase diagram of FIG. 5 or the composition of a slag having a high level of Ca represented by the "Q line," resulting in conditions where the slag is allowed to melt. A liquid phase generated due to the molten slag may increase the reduction kinetics of forming iron metal. If this occurs, the iron-metal forming reaction is difficult to be prevented.

Therefore, in the mixing process step S11 according to the present embodiment, an additive such as a flux is not added, or the addition amount of the additive is 10% or less relative to the mixed amount of the saprolite ore. This can effectively assure that the slag 50 remains in a half-molten state to reduce the iron-metal forming reaction more effectively.

Now, as shown in FIG. 4F, if a part of the metal shell 30 is in the liquid phase for a long time, reduction of iron oxide inside the metal shell 30 which remains unreduced may be promoted due to the carbonaceous reducing agent 10 arranged to cover the furnace floor 1*a*, resulting in a decreased nickel grade. To prevent this, it is preferred that the metal and slag are promptly taken out from the furnace, and further cooled to inhibit the reduction reaction.

Specifically, the process is preferably performed such that the time from charging the pellet 20 into the smelting furnace 1 to start the heat reduction treatment until taking out the pellet 20 from the smelting furnace is less than 40 minutes. Further, the pellet 20 is preferably cooled to a temperature of 500° C. or below within 8 minutes after taken out from the furnace. As described above, the time from the start of the heat reduction treatment until the taking out from the furnace is less than 40 minutes, and cooling is performed such that the temperature becomes 500° C. or below within 8 minutes. These can efficiently prevent the reduction reaction of the pellet 20, and stop the reduction of iron oxide present inside the metal shell 30 to prevent a decreased nickel grade.

As described above, in the present embodiment, the metal shell 30 and the metal particles 40 can be formed by virtue of a specific amount of the carbonaceous reducing agent 15 mixed in the pellet 20. At this time, nickel oxide is converted into metal while divalent iron oxide obtained from reduction of trivalent iron oxide is only partly reduced into metal. Consequently, the production of iron metal is reduced. Further, the heat reduction treatment is performed in a condition where the furnace floor 1*a* of the smelting furnace 1 is covered with the furnace-floor carbonaceous reducing agent 10. This allows an excess carbon component in the furnace-floor carbonaceous reducing agent 10 arranged to cover the furnace floor which is not involved in the aforementioned reduction reaction to be incorporated into an iron-nickel alloy in the metal shell 30 as the reduction treatment progresses, enabling appropriate carbonization, and also enabling some of the iron-nickel alloy to be melted and dispersed into the slag 50. These can produce an iron-nickel alloy (ferronickel) having a high nickel grade of 16% or more.

In particular, the amount of the carbonaceous reducing agent 15 to be mixed in the pellet 20 is adjusted to a specific ratio, i.e., adjusted so that the amount of carbon is 25% or less relative to the aforementioned total value of the chemical equivalents being 100%. The carbonaceous reducing agent 15 in that amount is mixed with other raw materials to procure the pellet 20, which is then subjected to the heat reduction treatment. This can allow a so-called partial reduction where some of iron oxide present in the resulting metal shell 30 remains unreduced in the reduction reaction, creating a state where the metal shell 30 which is thin and fragile remains. That is, formation of iron metal can be prevented effectively.

These enable effective enrichment of nickel, and also enable separate production of a ferronickel metal with a high nickel grade and a ferronickel slag in the inside of one pellet.

It is noted that the metal and the slag separately produced in the pellet 20 will not be mixed together, but form a mixture where the metal solid phase and the slag solid phase coexist as separate phases after subsequent cooling. The volume of this mixture is reduced to a volume on the order of 50% to 60% as compared with that of the charged pellet.

<3. Separation Step>

In the separation step S3, the metal and the slag produced in the reduction step S2 are separated to recover the metal. Specifically, the metal phase is separated and recovered from a mixture containing the metal phase (the metal solid phase) and the slag phase (the slag solid phase containing a carbonaceous reducing agent) in the thin metal shell 30 obtained from the reduction heat treatment of the pellet 20.

As a method for separating the metal phase and the slag phase from the mixture of the metal phase and the slag phase obtained as a solid, for example, the gravity separation method, the magnetic separation method and the like can used in addition to a method for removing large-sized particulate metal by sieving after cracking or grinding. Specifically, for example, the thin metal shell 30 is first crushed to crush a mixture of the metal and slag phases inside the metal shell, and sieving is performed followed by magnetic separation and the like. The resulting metal and slag phases have poor wettability, allowing them to be separated easily.

The metal and slag phases are separated as described above to recover the metal phase. It is noted the metal recovered in this way may be melted to manufacture a ferronickel (with a nickel grade of 16% or more).

EXAMPLES

Below, the present invention will be described in a more specific way with reference to Examples and Comparative Examples, but the present invention shall not be limited to the following Examples in any sense.

Example 1

Saprolite ore serving as raw material ore having a composition shown in Table 2 was mixed with a carbonaceous reducing agent to obtain a mixture. The mixed amount of the carbonaceous reducing agent included in the mixture was such that the amount of carbon was 6% relative to the total value of a chemical equivalent required for reducing nickel oxide contained in the resulting pellet into nickel metal and a chemical equivalent required for reducing iron oxide contained in said pellet into iron metal (the total value of the chemical equivalents) being 100%.

Next, an appropriate amount of water was added to the resulting mixture of the raw material powders, and kneading was performed by hand to form a spherical lump. Then, drying treatment was performed in which hot air at 300° C. to 400° C. was blown against the lump until the solid content of the resulting lump became about 70 wt %, and the water content became about 30 wt % to produce a spherical pellet (size (diameter): 17 mm).

Next, the furnace floor of a smelting furnace was covered with a coal powder (carbon content: 85 wt %, particle size: 0.4 mm) which served as a carbonaceous reducing agent, and 100 produced pellets were then charged so as to be loaded onto the furnace floor carbonaceous reducing agent arranged to cover the furnace floor thereof. The pellets were charged into the smelting furnace at a temperature condition of 600° C. or less.

Then, reduction heat treatment was performed in the smelting furnace at a reduction temperature of 1400° C. The pellets were taken out from the furnace 5 minutes after the start of the reduction heat treatment, and assured to be cooled to 500° C. or below within 1 minute after taken out from the furnace.

In the heat reduction treatment performed in this way, reduced pellets were obtained including a slag, a metal shell adhered to a portion of the slag, and metal particles with small particle sizes present in the slag. The resulting reduced pellets were completely melted, and analyzed for nickel and iron in the metal. The nickel and iron grades in the resulting metal are shown in Table 3 below. As shown in Table 3, the nickel grade is 29%, which is significantly higher than the nickel grade of 16% in ferronickels required by JIS. Further, the recovery rate of nickel is 95% or more as calculated from the mass balance based on the ore composition shown in Table 2.

TABLE 3

| | Grade [%] | |
|---|---|---|
| | Ni | Fe |
| Metal | 29 | 70 |

Example 2

Raw materials were mixed in a similar way as in Example 1 to obtain a mixture, and then pellets were manufactured. At this time, the mixed amount of the carbonaceous reducing agent as a raw material was such that the amount of carbon was 20% relative to the aforementioned total value of the chemical equivalents being 100%.

Next, the furnace floor of a smelting furnace was covered with a coal powder (carbon content: 85 wt %, particle size: 0.4 mm) which served as a carbonaceous reducing agent, and 100 produced pellets were then charged so as to be loaded onto the furnace floor carbonaceous reducing agent arranged to cover the furnace floor thereof. The pellets were charged into the smelting furnace at a temperature condition of 600° C. or less.

Then, reduction heat treatment was performed in the smelting furnace at a reduction temperature of 1400° C. The pellets were taken out from the furnace 5 minutes after the start of the reduction heat treatment, and assured to be cooled to 500° C. or below within 1 minute after taken out from the furnace.

Reduced pellets were obtained from the heat reduction treatment performed in this way. Metal grades in the reduced pellets were determined in a similar way as in Example 1. The nickel and iron grades in the resulting metal are shown in Table 4 below. As shown in Table 4, the nickel grade is 16%, which satisfies the nickel grade of 16% in ferronickels required by JIS. Further, the recovery rate of nickel is 95% or more as calculated from the mass balance based on the ore composition shown in Table 2.

TABLE 4

| | Grade [%] | |
|---|---|---|
| | Ni | Fe |
| Metal | 16 | 83 |

Example 3

Saprolite ore with a composition shown in Table 2 as raw material ore, limestone as a flux, and a binder as well as a carbonaceous reducing agent were mixed to obtain a mixture. The raw materials were mixed to obtain a mixture, and then dry pellets were manufactured. In Example 3, the mixed amount of the limestone as a flux was 8% in terms of the weight of the limestone relative to the mixed weight of the saprolite ore at this time. Further, the mixed amount of the binder was 1% relative to the mixed weight of the saprolite ore. Moreover, the mixed amount of the carbonaceous reducing agent was 6% in terms of the carbon content relative to the aforementioned total value of the chemical equivalents being 100%.

Next, the furnace floor of a smelting furnace was covered with a coal power (carbon content: 85 wt %, particle size: 0.4 mm) which served as a carbonaceous reducing agent, and 100 produced pellets were then charged so as to be loaded onto the carbonaceous reducing agent arranged to cover the furnace floor thereof. The pellets were charged into the smelting furnace under a temperature condition of 600° C. or less.

Then, reduction heat treatment was performed inside the smelting furnace at a reduction temperature of 1400° C. The pellets were taken out from the furnace 10 minutes after the start of the reduction heat treatment, and assured to be cooled to 500° C. or below within 1 minute after taken out from the furnace.

Reduced pellets were obtained from the heat reduction treatment performed in this way. The nickel and iron grades in the resulting metal are shown in Table 5 below. As shown in Table 5, the nickel grade is 20%, which is significantly higher than the nickel grade of 16% in ferronickels required by JIS. Further, the recovery rate of nickel is 95% or more as calculated from the mass balance based on the ore composition shown in Table 2.

TABLE 5

| | Grade [%] | |
|---|---|---|
| | Ni | Fe |
| Metal | 20 | 78 |

Example 4

A mixture was obtained in a similar way as in Example 1, and then pellets were manufactured. The resulting pellets were subjected to the heat reduction treatment in similar conditions. In Example 4, the pellets were taken out from the furnace 30 minutes after the start of the heat reduction treatment, and then assured to be cooled to 500° C. or below within 1 minute after taken out from the furnace.

Reduced pellets were obtained from the heat reduction treatment performed in this way. The nickel and iron grades in the resulting metal are shown in Table 6 below. As shown in Table 6, the nickel grade is 16%, which satisfies the nickel grade of 16% in ferronickel required by JIS. Further, the recovery rate of nickel is 95% or more as calculated from the mass balance based on the ore composition shown in Table 2.

TABLE 6

| | Grade [%] | |
|---|---|---|
| | Ni | Fe |
| Metal | 16 | 82 |

Comparative Example 1

The heat reduction treatment was performed in a similar was as in Example 1 except that only the pellets were charged into the smelting furnace without covering the furnace floor of the smelting furnace with a coal powder as the carbonaceous reducing agent.

As a result, a metal shell was not formed during the process of the reduction reaction, but unreacted ore, a partly molten small slag lump, and a trace amount of metal particles dispersed in the small slag lump coexisted inside the slag pellet. These results show that in Comparative Example 1, the reduction reaction itself was not sufficiently promoted.

Comparative Example 2

Raw materials were mixed in a similar way as in Example 1 to obtain a mixture, and then dry pellets were produced. At this time, in Comparative Example 2, the mixed amount of the carbonaceous reducing agent as a raw material was such that the amount of carbon was 30% relative to the aforementioned total value of the chemical equivalents being 100%.

Next, the furnace floor of a smelting furnace was covered with a coal powder (carbon content: 85 wt %, particle size: 0.4 mm) which served as a carbonaceous reducing agent, and 100 produced pellets were then charged so as to be loaded onto the furnace floor carbonaceous reducing agent arranged to cover the furnace floor thereof. The pellets were charged into the smelting furnace at a temperature condition of 600° C. or less.

Then, reduction heat treatment was performed in the smelting furnace at a reduction temperature of 1400° C. The pellets were taken out from the furnace 15 minutes after the start of the reduction heat treatment, and assured to be cooled to 500° C. or below within 1 minute after taken out from the furnace.

Reduced pellets were obtained from the heat reduction treatment performed in this way. The resulting reduced pellets were analyzed as in Example 1. The nickel and iron grades in the resulting metal are shown in Table 7 below. As shown in Table 7, the nickel grade was 11%, showing that nickel in the metal was not sufficiently enriched, and a metal satisfying the ferronickel grade (a nickel grade of 16% or more) was not able to be obtained.

TABLE 7

| | Grade [%] | |
|---|---|---|
| | Ni | Fe |
| Metal | 11 | 87 |

Comparative Example 3

Raw materials were mixed to obtain a mixture in a similar way as in Example 1, and then dry pellets were manufactured. Then 100 pieces of the resulting pellets were charged so as to be loaded on the carbonaceous reducing agent arranged to cover the furnace floor. It is noted that charging the pellets into the smelting furnace was performed at a temperature condition of 600° C. or below.

In Comparative Example 3, the heat reduction treatment was performed in the smelting furnace at a reducing temperature of 1300° C. The pellets were taken out from the furnace 10 minutes after the start of the heat reduction treatment, and assured to be cooled to 500° C. or below within 1 minute after taken out from the furnace.

As a result, unreacted ore, a molten slag, and a trace amount of metal particles dispersed in the small slag lump thereof coexisted inside the resulting reduced pellets. These results show that in Comparative Example 3, the reaction was not sufficiently promoted, and the recovery of nickel was as low as about 60%.

Comparative Example 4

Raw materials were mixed to obtain a mixture in a similar way as in Example 1, and then dry pellets were manufactured. Then 100 pieces of the resulting pellets were charged so as to be loaded on the carbonaceous reducing agent arranged to cover the furnace floor. It is noted that charging the pellets into the smelting furnace was performed at a temperature condition of 600° C. or below.

In Comparative Example 4, the heat reduction treatment was performed in the smelting furnace at a reducing temperature of 1570° C. The pellets were taken out from the furnace 5 minutes after the start of the heat reduction treatment, and assured to be cooled to 500° C. or below within 1 minute after taken out from the furnace.

Lumps of metal and slag which appeared to be resolidified after melted were separately obtained after the heat reduction treatment performed in this way. The nickel and iron grades in the resulting metal are shown in Table 8 below. As shown in Table 8, the nickel grade was 8%, showing that nickel in the metal was not sufficiently enriched, and a metal satisfying the ferronickel grade (a nickel grade of 16% or more) was not able to be obtained.

TABLE 8

| | Grade [%] | |
|---|---|---|
| | Ni | Fe |
| Metal | 8 | 89 |

Comparative Example 5

A mixture was obtained in a similar way as in Example 3, and then pellets were manufactured. The resulting pellets were subjected to the heat reduction treatment in similar conditions.

In Comparative Example 5, after confirming that the reduction reaction was completed 10 minutes after the start of the heat reduction treatment, the pellets were taken out from the furnace 40 minutes after the start of the heat reduction treatment, and then assured to be cooled to 500° C. or below within 1 minute after taken out from the furnace.

Reduced pellets were obtained from the heat reduction treatment performed in this way. The resulting reduced pellets were analyzed as in Example 1. The metal and iron grades in the resulting reduced pellets are shown in Table 9 below. As shown in Table 9, the nickel grade was 14%, showing that nickel in the metal was not sufficiently enriched, and a metal satisfying the ferronickel grade (a nickel grade of 16% or more) was not able to be obtained.

TABLE 9

| | Grade [%] | |
|---|---|---|
| | Ni | Fe |
| Metal | 14 | 85 |

Comparative Example 6

Raw materials were mixed to obtain a mixture in a similar way as in Example 1, and then dry pellets were manufactured. Then 100 pieces of the resulting pellets were charged so as to be loaded on the carbonaceous reducing agent arranged to cover the furnace floor. It is noted that charging the pellets into the smelting furnace was performed at a temperature condition of 600° C. or below.

In Comparative Example 6, the heat reduction treatment was performed in the smelting furnace at a reducing temperature of 1650° C. The pellets were taken out from the furnace 5 minutes after the start of the heat reduction treatment, and assured to be cooled to 500° C. or below within 1 minute after taken out from the furnace.

Lumps of metal and slag which appeared to be resolidified after melted were separately obtained after the heat reduction treatment performed in this way. The nickel and iron grades in the resulting metal are shown in Table 10 below. As shown in Table 10, the nickel grade was 6%, showing that nickel in the metal was not sufficiently enriched, and a metal satisfying the ferronickel grade (a nickel grade of 16% or more) was not able to be obtained.

TABLE 10

| | Grade [%] | |
|---|---|---|
| | Ni | Fe |
| Metal | 6 | 93 |

EXPLANATION OF REFERENCE NUMERALS

10 Furnace floor carbonaceous reducing agent (arranged to cover furnace floor)
20 Pellet
30 Metal shell (Shell)
40 Metal particle
50 Slag

The invention claimed is:

1. A method for smelting saprolite ore, in which a pellet is formed from the saprolite ore, and the pellet is heat-reduced to obtain an iron-nickel alloy with a nickel grade of 16% or more, the method comprising:

the pellet production step comprising mixing the saprolite ore with at least a carbonaceous reducing agent to form a mixture, the amount of the carbonaceous reducing agent being adjusted so that the amount of carbon in the mixture is 0.1% or more, and 25% or less when the total value of a chemical equivalent required for reducing nickel oxide contained in the resulting pellet into nickel metal and a chemical equivalent required for reducing iron oxide contained in said pellet into iron metal is taken as 100%, and agglomerating the mixture to form a pellet, and the reduction step comprising pre-covering the furnace floor of the smelting furnace with a furnace floor carbonaceous reducing agent in an amount that enables a metal shell formed during the reduction step to be melted and the melted metal shell to be dispersed in a slag formed during the reduction step before charging the resulting pellet into the smelting furnace, loading the pellet onto the furnace floor carbonaceous reducing agent, and heat-reducing the pellet loaded onto the furnace floor carbonaceous reducing agent at a heating temperature of 1350° C. or more and 1550° C. or less, wherein the time from the start of heat-reducing until the pellet is taken out from the smelting furnace in the reduction step is less than 40 minutes.

2. The method for smelting saprolite ore according to claim 1, wherein the temperature when the pellet is charged into the smelting furnace is 600° C. or less.

3. The method for producing saprolite ore according to claim 1, wherein the pellet production step comprises adding a binder, and/or a flux component as an additive other than the carbonaceous reducing agent such that the loading amount of the additive except for the carbonaceous reducing agent is 10% or less relative to the saprolite ore by weight.

4. The method for smelting saprolite ore according to claim 1, further comprising pulverizing a reduced product obtained from the reduction step, and separating a metal including the iron-nickel alloy from a slag, and then melting the metal to obtain a ferronickel.

* * * * *